United States Patent [19]

Gero

[11] 4,172,520

[45] Oct. 30, 1979

[54] CIGARETTE DISPENSING PACKAGE

[75] Inventor: Gabriel Gero, Staten Island, N.Y.

[73] Assignees: Andre Gero, Stanten Island; Anthony J. Distefano, Huntington Station; Domenick W. Distefano, Elmhurst, all of N.Y. ; part interest to each

[21] Appl. No.: 836,749

[22] Filed: Sep. 26, 1977

[51] Int. Cl.[2] ..... B65D 5/32; B65D 85/10

[52] U.S. Cl. ..... 206/265; 206/250; 229/44 CB

[58] Field of Search ..... 229/11, 20, 44 CB; 206/815, 45.15, 45.18, 248, 250, 252, 254, 259, 264, 265, 266, 267, 270, 271, 273, 274, 275

[56] References Cited

U.S. PATENT DOCUMENTS

| | | | |
|---|---|---|---|
| 2,071,856 | 2/1937 | Segal | 206/607 |
| 2,339,656 | 1/1944 | Shina | 206/264 |
| 2,533,255 | 12/1950 | Will | 206/607 |
| 2,958,418 | 11/1960 | O'Gorman | 206/273 |
| 3,037,678 | 6/1962 | Caruso | 206/273 |
| 3,052,398 | 9/1962 | Benjamin | 206/273 |
| 3,282,465 | 11/1966 | Davis | 206/250 |
| 3,583,625 | 6/1971 | Gero | 206/264 |
| 3,749,234 | 7/1973 | Gero | 206/266 |
| 3,863,760 | 2/1975 | Dong et al. | 206/254 |
| 3,881,599 | 5/1975 | Flaherty | 206/273 |

*Primary Examiner*—Herbert F. Ross

*Attorney, Agent, or Firm*—Friedman, Goodman & Teitelbaum

[57] ABSTRACT

A cigarette dispensing package and blank are provided wherein an inner shell is pivotably movable within an outer shell between a fully contained closed position and a partially extending open position. The economical package construction embodies a two-piece blank with a novel toggle lock tab which can be loaded on conventional cigarette equipment with generally negligible conversion. In addition, a novel foil bundle is disclosed which facilitates loading during manufacture, and precludes damage to the cigarettes when the package is opened as the novel foil bundle cooperates with the movement of the inner shell within the outer shell.

33 Claims, 30 Drawing Figures

FIG. 1
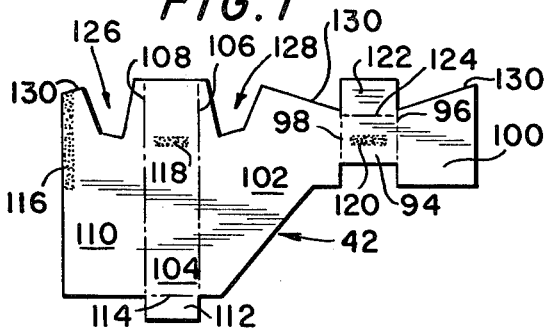
FIG. 6
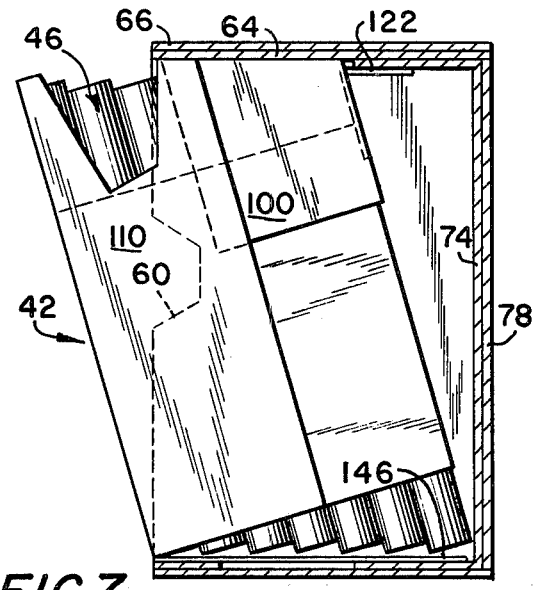
FIG. 3
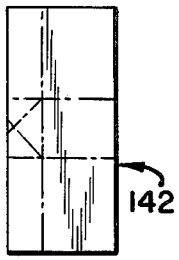
FIG. 2
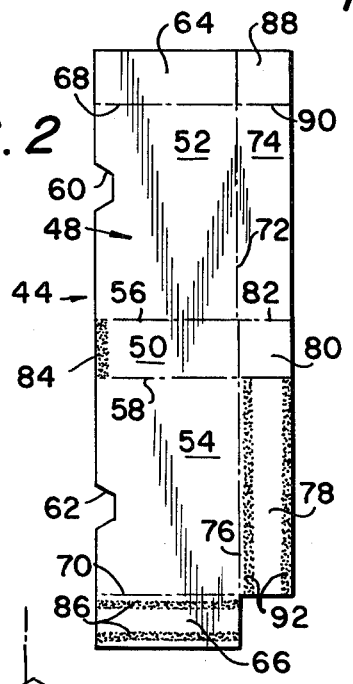
FIG. 7
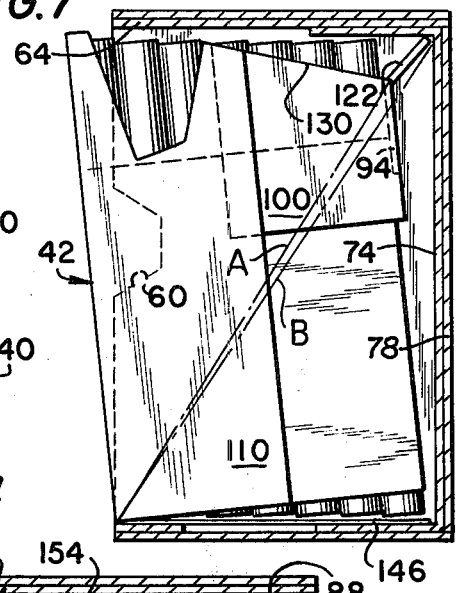
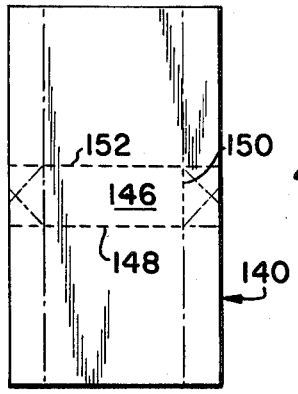
FIG. 5
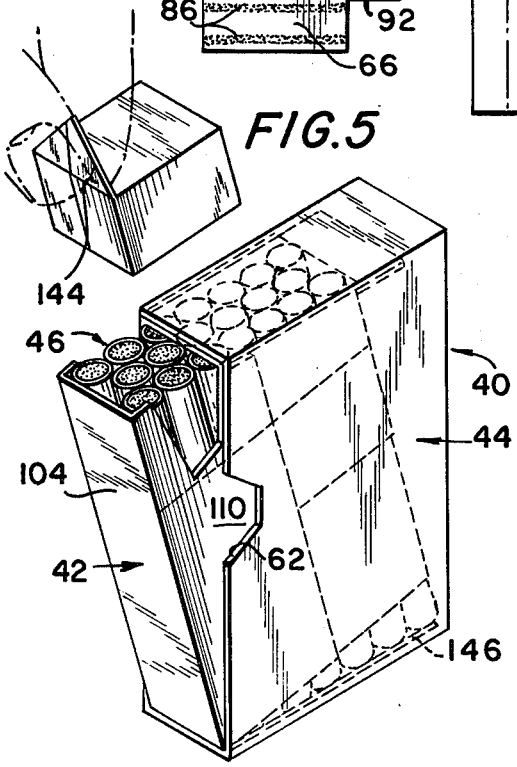
FIG. 4
FIG. 8
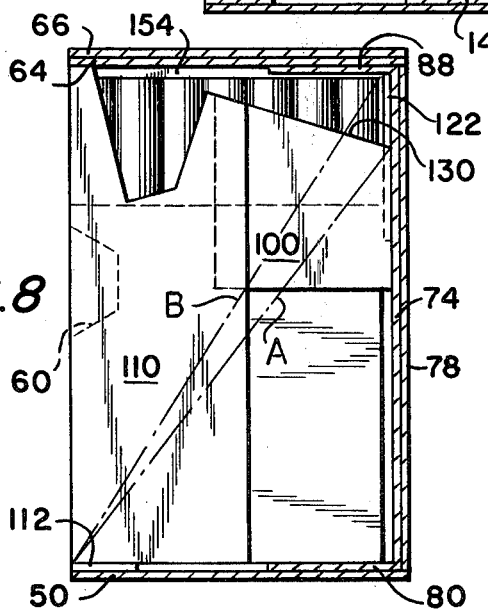

CIGARETTE DISPENSING PACKAGE

CROSS-REFERENCES TO RELATED APPLICATIONS:

This application is related to my earlier patent applications, now identified as U.S. Pat. No. 3,583,625, granted June 8, 1971, and U.S. Pat. No. 3,749,234, granted July 31, 1973. Additionally, this application is based in part on my U.S. Disclosure Document No. 050,734, filed in the U.S. Patent and Trademark Office on July 9, 1976.

BACKGROUND OF THE INVENTION:

This invention relates to novel cigarette packages of the type embodying containers which are comprised of two-piece blank constructions forming an inner shell-outer shell structure for dispensing cigarettes and the like, and to a foil bundle which provides for a partial breakaway bottom portion enabling easy loading on conventional equipment and manual access to the contents of the package construction without damaging or bending or breaking the cigarettes when the inner shell is pivoted to the fully extended open condition and returned to a fully closed position.

In my prior cigarette dispensing package constructions, the inner shell is fixedly secured to the outer shell by means of a snap-lock panel or tab. With such a construction embodying an overcenter snap-lock means, the inner shell is movable between two clearly defined positions, namely, a first or closed position completely within the outer shell and a second position partially out of the confines of the outer shell in which position the cigarettes are accessible. These structures were primarily of the single piece blank type which involves a considerably greater use of paper board and therefore a more expensive package construction. Also, such one-piece blank constructions do not lend themselves to existing packaging machinery without extensive modifications.

There are many other package structures known in the art, but these also are not commercially expedient or economically justifiable because of one or more disadvantages or defects associated with such particular package designs and constructions. For example, the eight references cited during prosecution of my earlier aforementioned patent (U.S. Pat. Nos. 2,002,364; 2,201,333; 2,901,097; 3,052,398; 3,206,100; 3,207,416; 3,241,737 and French Pat. No. 1,208,736) all exhibit features and elements which are totally different and clearly distinguishable from the invention disclosed herein and are consdiered merely as background type prior art of little significance. The same holds true for the six additional "non-common" references cited during prosecution of my most recently issued aforementioned patent (U.S. Pat. Nos. 1,735,323; 2,148,319; 2,929,524; 3,107,008; 3,127,083 and Canadian Pat. No. 766,586). These prior art patents are all considered as cumulative references and are simply noted herein for background purposes relative to other like type cigarette dispensing packages.

Other examples of cigarette dispensing packages are shown in U.S. Pat. Nos. 1,394,591; 3,037,678, and 3,881,599 as well as in my own Canadian Pat. No. 766,586, and in British Pat. No. 979,355 and in Swiss Pat. No. 339,117. These patents also lack the features and advantages of the present invention in that they are concerned with other types of construction, although they are generally of the side-opening box type of construction.

Accordingly, it is an object of the present invention to provide a dispenser package for cigarettes and the like which includes inner and outer shells pivotably secured to each other between accessible and inaccessible positions, and which further include new and improved means for locating the inner shell in either of its two basic positions.

Another object of the present invention is to provide such a dispenser package for cigarettes and the like which includes a novel foil wrapper or liner consisting of one or two parts, which embodies a breakaway bottom portion for facilitating removal of cigarettes without any damage thereto upon opening of such package construction when the pack is new. The breakaway foil bottom construction allows the cigarette bundle to cooperate with movement of the inner shell within the outer shell so as to preclude damage to the ends of the cigarettes.

Yet still another object of the invention is to provide novel two-piece blanks which are adaptable to existing commercial machinery, and which are more economically feasible due to the small amount of paperboard required and one side printing and coating for such package constructions.

The present invention will be better understood and objects and important features other than those specifically enumerated above will become apparent when consideration is given to the following details and description, which, when taken in conjunction with the annexed drawings, describes, discloses, illustrates and shows preferred embodiments or modifications of the present invention and what is presently considered and believed to be the best mode of practicing the principles thereof. Other embodiments or modifications may be suggested to those having the benefit of the teachings herein, and such other embodiments or modifications are intended to be reserved especially as they fall within the scope of the subjoined claims.

BRIEF DESCRIPTION OF THE DRAWINGS

FIG. 1 is a plan view of an inner shell blank having an integral toggle lock tab or panel constructed in accordance with the teachings of the present invention;

FIG. 2 is a plan view of an outer shell blank adapted for use with the inner shell blank of FIG. 1 in formation of a package of the present invention utilizing the blank parts of FIGS. 1 and 2;

FIG. 3 is a plan view of a top removable corner piece or portion of an inner foil blank or wrap with fold indentation lines shown in dot-dash fashion;

FIG. 4 is a plan view of the body portion of the inner foil blank or wrap with the bottom portion thereof shown perforated on three sides to provide a partial breakaway portion, as will be explained hereinafter;

FIG. 5 is a top perspective view illustrating the initially opened condition of the assembled package with the corner piece or portion of the inner foil wrap shown removed or detached from the cigarette bundle.

FIG. 6 is a sectional elevational view of a fully assembled inner and outer shell shown in a complete open relation or package condition;

FIG. 7 is another sectional elevational view, similar to that of FIG. 6, but with the inner shell only partially out of the confines of the outer shell in an intermediate position;

FIG. 8 is a sectional elevational view similar to that of FIG. 3, but showing the package in its closed condition;

Figure 9:
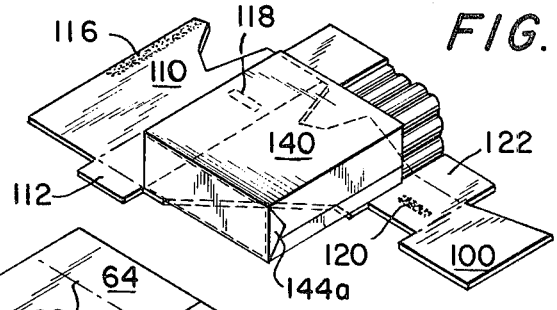
FIG. 9 is a perspective view of a cigarette bundle wherein the cigarettes are wrapped in a foil wrap and the bundle is shown being wrapped into the inner shell package.
Figure 10:
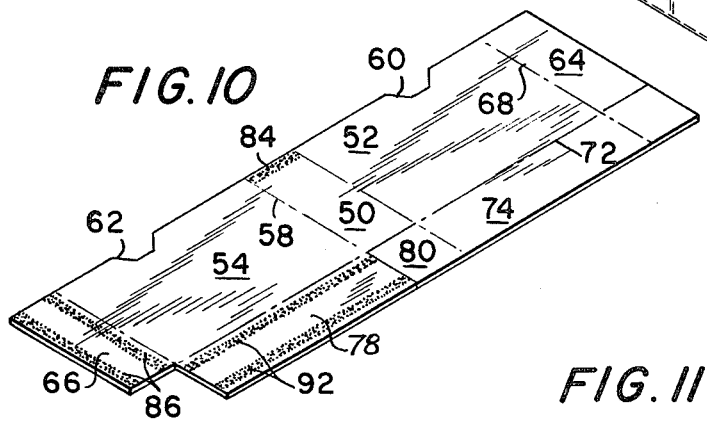
FIGS. 10–13 illustrate various steps in the assembly of the package of the present invention wherein the inner shell blank is secured to the outer shell blank.
Figure 11:
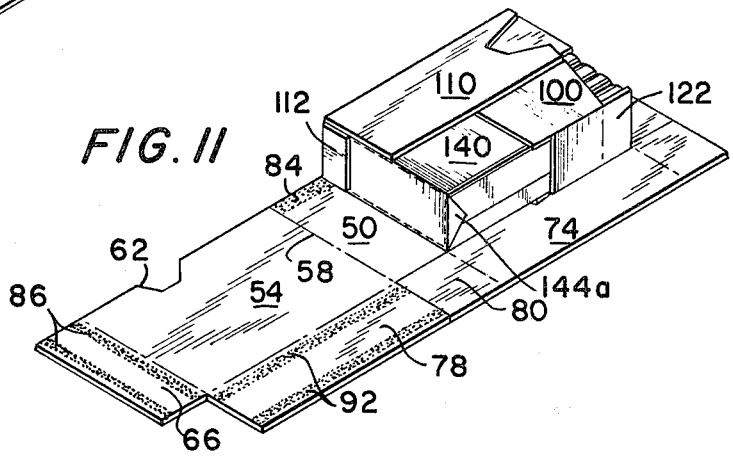
Figure 12:
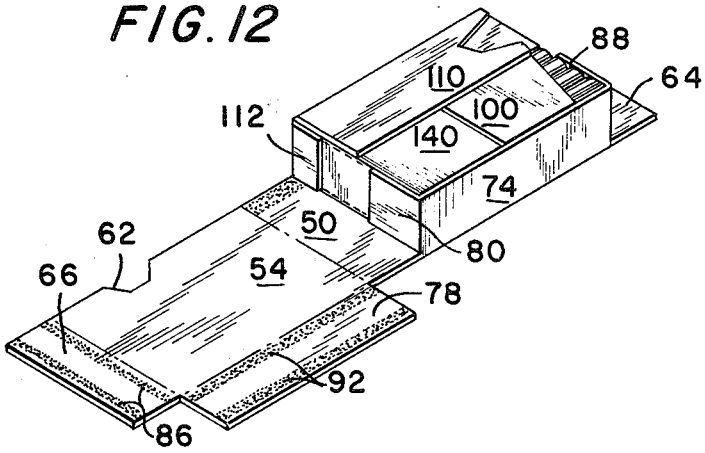

DESCRIPTION OF THE PREFERRED EMBODIMENTS:

With reference to the drawings, particularly FIGS. 1–14 thereof, there is shown and illustrated novel and improved dispensing packages for cigarettes and the like constructed in accordance with the principles of the present invention and designated generally by the reference character 40 comprising an inner shell blank part or member 42 and outer shell member 44. Each shell member comprises a blank fabricated from a single sheet of resilient, stiff, bendable material, such as cardboard, or other suitable sheet material. As seen in FIG. 5, the package container 40 stores a bundle or quantity of cigarettes 46, such as 20 or 25 cigarettes, for dispensing from the container, but it is understood that other articles may be stored and dispensed by the container, if desired, such as chewing gum, band-aids, etc.

The blank part 48 of FIG. 2 is adapted to form the outer shell 44 of the package 40 when assembled, and includes a generally rectangular outer shell bottom wall 50, and a pair of generally rectangular outer shell side walls 52 and 54 extending respectively from opposite sides of the bottom wall and hingedly connected thereto by fold lines 56 and 58. The side wall panels 52 and 54 may be respectively formed along their forward edges with finger notches or cutouts 60 and 62, and are further provided at their outer or upper ends with respective top wall panels 64 and 66 hingedly connected, as by fold lines 68 and 70 to the adjacent side wall panels.

Extending from the rear edge of side wall panel 52, being hingedly connected thereto by fold line 72, is an inner rear wall panel 74. The side wall panel 54 has its rear edge defined by a fold line 76, and an outer rear wall panel 78 hingedly connected by the fold line 76 to the side wall panel 54. A tab 80 extends from the lower end of rear wall panel 74, being hingedly connected to the latter by a fold line 82.

In addition, the bottom wall panel 50 is suitably provided at one end with an adhesive coating 84. The top wall panel 66 may be covered with strips of adhesive 86, while the complementary top wall panel 64 of the instant embodiment does not require any adhesive coating.

A dust tab 88 extends from a fold line 90 at the upper end of the inner rear wall panel 74. Strips of glue 92 are also provided on the outer rear wall panel 78 for use in securing same to the inner rear wall panel 74.

The inner shell blank part 42 is shown in FIG. 1, and includes an inner rear wall panel 94 bounded on opposite side edges by a pair of parallel fold lines 96 and 98. Extending from the rear wall panel 94 and hingedly connected thereby by fold line 96 is a partial side wall panel 100. Extending from and hingedly connected to the other side of the rear wall panel 94, as by the fold line or crease 98, is a full or complete side wall panel 102, and a front wall panel 104 is hingedly connected to the side wall panel 102 by a fold line or crease 106. Extending from the other side of the front wall panel 104, and hingedly connected thereto by a fold line or crease 108, is an additional partial side wall panel 110. A lower end flap 112 extends from the lower end of the front wall panel 104, being hingedly connected thereto by a fold line 114. The partial side wall panel 110 may be adhesively coated, as at 116 for securement to panel 100.

Suitable glue areas 118 and 120 are respectively provided on the panels 104 and 94, for use in securing and holding the cigarette bundle in place in said inner shell during assembly of the package. Of course, the bundle may be attached elsewhere to the inner shell, if desired.

An extended rear side wall panel toggle-type lock tab 122 (unconnected to the outer shell 44) is connected by a fold line 124 to the panel 94. The width of the panel, and/or the width of the toggle lock tab 122, is slightly wider than the space between the outer shell side walls 52 and 54, say in the order of about 1/32 of an inch, such that frictional engagement will occur between inner and outer shells 42 and 44 during operation of the package. Also, panels 100 and 102 may have small wing-like cutouts (not shown) terminating at fold lines 96 and 98, at which locations said fold lines are discontinuous at said cutouts for the full lengths of the cutouts. These cutouts may be provided in an intermediate position relative to panel 94 and extend slightly beyond fold lines 96 and 98 for providing the same type of frictional engagement between outer shell panels 52 and 54.

The cutout portions 126 and 128 are respectively provided in the panels 110 and 102 so as to generally form a corner opening in the inner shell so as to enable access to the cigarettes when the package is opened, as best shown in FIGS. 5–7. Portions of the upper edges of the inner side panels 110, 102 and 100 are angularly configured as at 130 for the locking in at the top of the inner shell member 42 as it is pivotably rotated out of the confines of the outer shell 44, see particularly FIG. 6. This action occurs smoothly during numerous operations of the package. In use, the toggle lock tab 122 is first "snapped" or "popped" so as to initially break the toggle-like hold maintained on the package by the tab 122 when it is in the closed condition. Thereafter, the inner shell member 42 is free to be pivotably rotated out of the confines of the outer shell member 44 and same occurs until frictional resistance builds up as the angled surfaces 130 of the side panels frictionally slide along the top wall panel 64 and lock in place against the top of the outer shell member, as best shown in FIG. 6.

As best shown in FIG. 7, when the toggle lock tab or panel 122 is abutting the corner at fold line 90, the inner shell 42 "snaps" closed upon further pressure being applied to the panel 104 of the inner shell 42. The toggle lock tab 122 also maintains the cigarette package 40 in a completely closed condition when it is not in use and "snaps" to the initial opening condition of FIG. 7 upon a user gripping the inner shell 42 with one's fingers near the finger notches 60, 62 and pivotably moving the inner shell 42 out from the confines of the outer shell 44. Thereafter, the inner shell 42 slides rather freely until frictional resistance is built up and the top inclined edges 130 of the panels 100, 102 and 110 abut against the top wall panel 64, thereby limiting the travel of the inner shell 42 to a maximum fully accessible or open condition, as best shown in FIGS. 5 and 6. The toggle lock tab 122 is made slightly longer than ordinarily necessary so as to generate a stiffer closure "snap" type action, although a tight retention of the two shells together is not absolutely necessary.

It should be recognized that the width of the toggle lock tab 122 is preferably slightly greater than the spacing between the side wall panels 102 and 110 such that there exhibits a slight resistance to the free movement of the inner shell 42 as it is withdrawn from the outer shell 44 to its fully open or accessible position.

The bundle 46 of cigarettes is preferably wrapped in a suitable liner, such as a thin sheet or foil liner, as best shown in the plan view of FIGS. 3 and 4. In this arrangement, the foil liner comprises a large or main body part or portion 140 enclosing or wrapping most of the length of the cigarettes and a smaller part or top portion 142, both having a plurality of score or fold lines. When a fresh pack of cigarettes is first opened, the top portion 142 of the foil liner is removed, thus exposing the cigarettes (see FIG. 5). In the embodiment shown in FIGS. 1–14, the top portion 142 is separate from the main body portion 140, but it may be integral therewith and scored peripherally as will be described hereinafter with respect to FIG. 27 so as to be torn away when lifted by one's fingers.

In FIG. 3, note that the tuck or corner fold is preferably made such that a depending or extending triangular tab 144 is formed externally for easy gripping purposes during initial removal of the top portion 142 during opening of a fresh pack of cigarettes.

More importantly, the bottom panel 146 of the main body portion 140 of the foil liner is perforated on three sides 148, 150 and 152 so as to provide a partial breakaway portion by breaking along the three perforated sides due to the pressure from the cigarettes as the inner shell 42 is pivotably moved from its initially closed condition to the open position. In FIGS. 5–7, the bottom panel 146 is shown separated on three sides from the main body portion 140 of the foil liner or wrapper. Although not shown, it should also be noted that the tucks or corner folds **144*a* (only one shown in FIG. 9) of the main body portion 140**, like that of the top portion, may be conveniently disposed externally of the foil liner. For example, with such arrangement, both bottom corners are folded so that the corners are externally disposed, and thus the corners do not interfere with the bottom of the cigarettes in the bundle, particularly when cigarettes are returned to the package by a user.

It should be recognized that with the panel 94 disposed near the upper end of the pack relative to the cigarette bundle height, there is less of a tendency of the upper ends of the cigarettes to "hang-up" by scraping the dust tab 88 upon opening of the package. The slight clearance gap 154 (see FIG. 8) between the cigarette height and the height of the outer shell also lends itself to precluding such scraping action by the cigarette tops. If such action occurred, some of the cigarettes could conceivably bend and break at a point near their tops.

The method of setting up the pair of blank parts (inner shell 42 and outer shell 44) to form the package is shown in FIGS. 9–14. The inner shell or blank part 42 is first completely folded about a group or bundle of cigarettes (with or without foil liner, although the foil liner is preferred as it holds the bundle of cigarettes together) as at FIG. 9. The spots or lines of glue 118 and 120 are preferably located where shown on the panels 104 and 94, respectively, since they provide the best locations for machinery purposes and they securely hold the cigarette bundle to the inner shell 42.

The outer shell blank part 48 shown in FIGS. 10–13 with the side wall panel 54 and the bottom panel 50 are together swung upwardly about the fold line 56, after the rear wall panel 74 is swung forwardly about its hinged connection 72, with end dust flaps 80 and 88 also folded over to rest against the top and bottom surfaces of the bundle, with the forward lower end tab or flap 112 of the inner shell 42 simultaneously swung inwardly and upwardly against the bottom of the bundle. The inner shell is thus seated on the bottom wall 50 to secure the flap 112 to the adhesive region 84.

Figure 13:
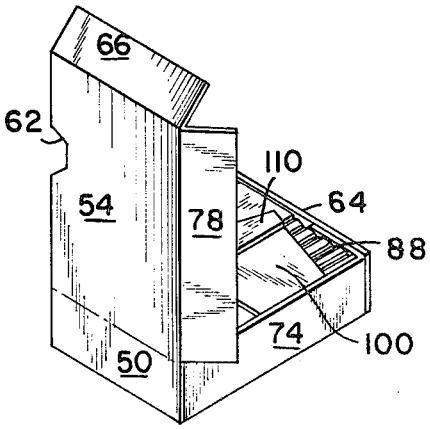

It is then only necessary to swing the side wall panel 54 downwardly onto the inner shell 42 as best shown in FIG. 13, with the panels 66 and 78 respectively folded onto and automatically secured onto the top inner panel 64 and the inner rear wall panel 74. Thus the rear wall panel 78 will be adhesively secured to the rear wall panel 74 except along any uncoated regions of the panel. The dust panel tab or flap 88 remains unsecured to any panel as noted hereinbefore.

In order to complete the package, it is only necessary to swing the panel or top wall section 64 inwardly and downwardly, and subsequently swing the outer panel or top wall section 66 inwardly and downwardly into adhesive securement with the inner top wall section or panel 64.

Figure 14:
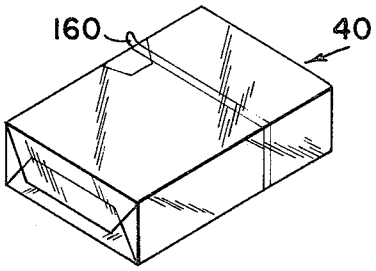
FIG. 14 is a perspective view of a complete cigarette package with a cellophane overwrap and tear strip.
Figure 15:
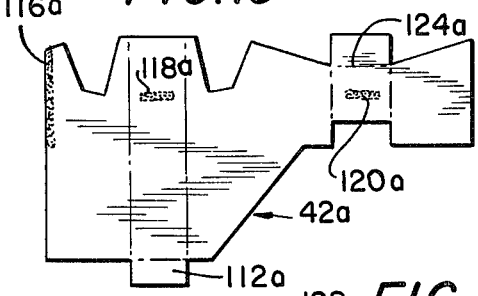
FIG. 15 is a plan view of an inner shell blank slightly modified from that of FIG. 1, and also having an integral toggle lock tab or panel.

The instant package 40 may then be conveniently wrapped in cellophane embodying a tear strip 160, as is conventionally done in the market and as is best shown in FIG. 14. Upon removal of the cellophane wrapper, the package 40 may be opened, as by grasping through the finger notches 60 and 62 to swing the inner shell 42 to its open position shown in FIGS. 5 and 6. In the latter figure it will be seen that the toggle lock tab or panel 122 defines a loose type of "snap lock" swingable to over-center positions in the manner of a simple toggle linkage, and is integral with the inner rear wall panel 94 of the inner shell 42.

Figure 22:
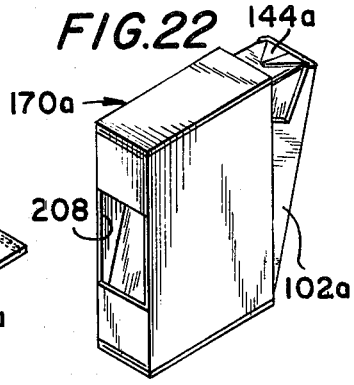
FIG. 22 is a top perspective view of the fully assembled package, taken from the rear side thereof, and illustrating the inner and outer shells of FIGS. 20 and 21 with the foil assembly of FIGS. 3 and 4.
Figure 18:
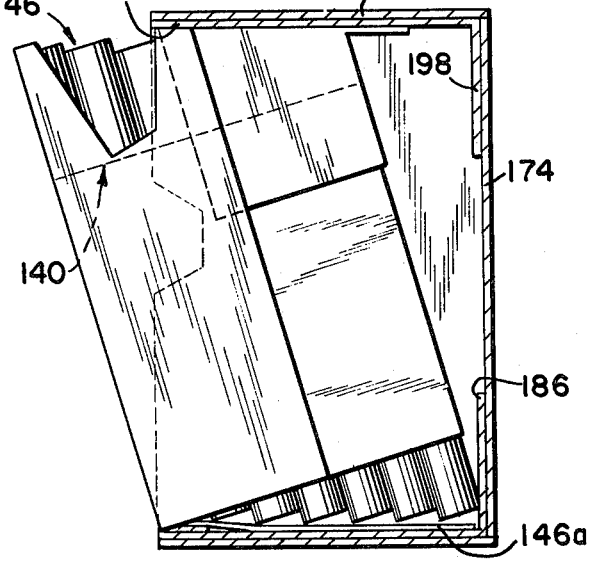
FIG. 18 is a sectional view of the inner and outer shells of FIGS. 15 and 16, shown in the open condition.
Figure 23:
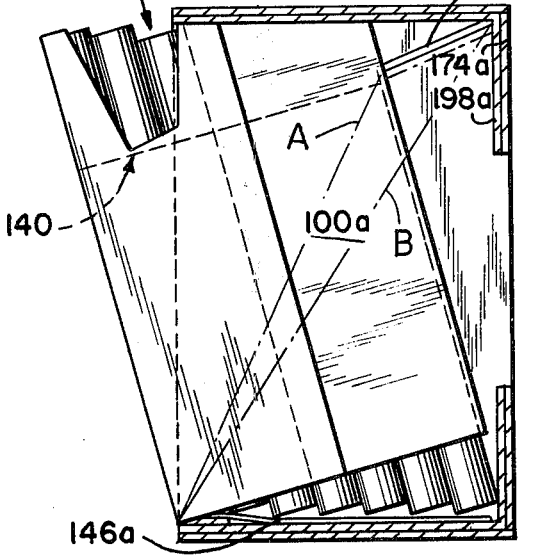
FIG. 23 is a sectional elevational view of the package of FIG. 22.
Figure 24:
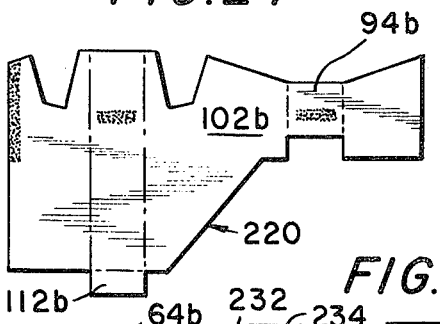
FIG. 24 is a plan view of a further modified inner shell panel which is not provided with a toggle lock tabe or panel.
Figure 25:
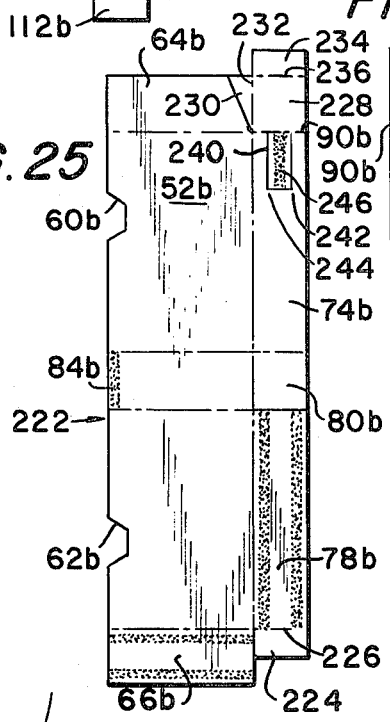
FIG. 25 is a plan view of another modified outer shell panel of the type shown in FIG. 2, but with a toggle lock tab, on the inner sidewall panel, having a side wing extending therefrom and a further extended tab for adhesive securance to the inner shell.
Figure 26:
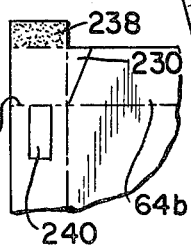
FIG. 26 is a fragmentary plan view of the top portion of the reverse side of the outer shell blank, showing reverse glue application to the tab extending from the toggle lock which joins the inner and outer shells.

While the rear walls 74, 78 of the outer shell 44 is imperforate, it will be appreciated that the outer shell rear wall may be provided with a finger opening, if desired, as will be hereinafter described for single-handed squeeze-type operation with respect to FIGS. 21–23.

From the foregoing, it will now be appreciated that the outer shell is constituted of a generally rectangular or multi-edge bottom wall or surface, as provided by the bottom wall panel 50. A plurality of side walls upstand from the bottom wall along the edges thereof, the side walls 52 and 54 upstanding from opposite sides of the bottom wall 50 and rear walls 74, 78 upstanding from the rear edge of said side walls 52 and 54. The number of upstanding walls 52, 54 and (74, 78) is less than the number of edges of the bottom wall 50, so that the outer shell 44 has its front open, as between the front edges of the upstanding side walls 52 and 54.

Figure 16:
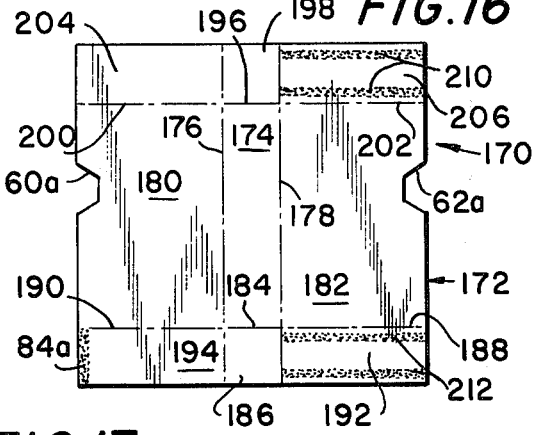
FIG. 16 is a plan view of an alternate outer shell blank construction where the two large face panels with finger notches are disposed horizontally from the rear sidewall panel.

The embodiments of FIGS. 15–16 and 20–21, differ slightly as will appear presently. With the modification of FIGS. 15–16, the inner shell **42*a* is identical to that shown in FIG. 1, but the outer shell 170 of FIG. 16 is of slightly different configuration. As shown therein, the outer shell blank 172 includes a generally rectangular, elongated outer shell rear wall panel 174, along the opposite longitudinal or side edges 176 and 178 of which are secured generally rectangular, longitudinally coextensive, elongated outer shell side wall panels 180 and 182. Below the lower cut edge 184 of panel 174 is an outer shell full rear wall bottom dust tab 186 connected to a flap 194, while the lower edges 188 and 190 of the side wall panels 182 and 180, respectively, are provided with outer shell side bottom wall panels or flaps 192 and 194, respectively. Above the upper cut edge 196 of the rear wall panel 174 is another dust tab hinge panel 198. The upper edges 200 and 202 of the outer shell side wall panels 180 and 182, respectively, each have hingedly connected thereto the outer shell top panels 204 and 206**, respectively.

While not specifically illustrated, it will be appreciated and can be shown that a pair of blanks **42*a* or 42 may be arranged in generally coplanar relation with tab 112 in an interfitting relationship in the cutout below panel 94**. In such arrangement, it will be apparent that two blanks may be economically and conveniently cut from a single standard rectangular blank or square-like sheet of cardboard so as to minimize paper waste and improve the efficiency of the cigarette packaging machinery presently employed and considered as conventional or standard equipment.

Figure 21:
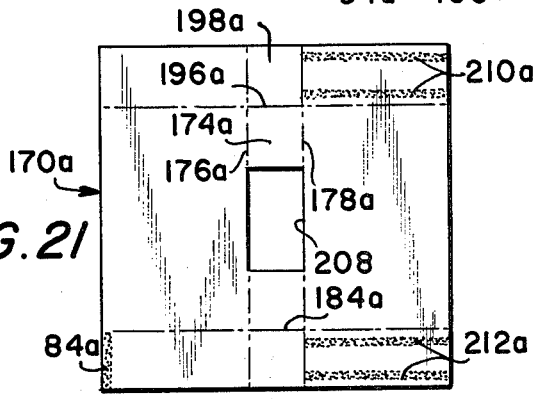
FIG. 21 is a plan view of another modified outer shell panel having a rectangular cut out opening in the rear sidewall panel for manual access to the rear sidewall panel of the inner shell for opening the package with one hand.
Figure 17:
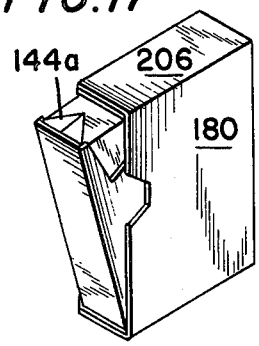
FIG. 17 is a top perspective view of the fully assembled package similar to that of FIG. 5 shown in the open condition, but embodying the inner and outer shells of FIGS. 15 and 16, and including the foil assembly of FIGS. 3 and 4.
Figure 19:
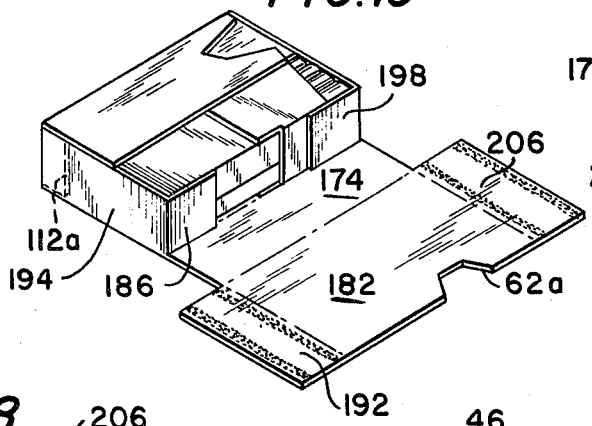
FIG. 19 is a perspective view similar to that of FIG. 11, but illustrating formed and filled inner shell of FIG. 15 overlaying face panel of outer shell of FIG. 16 during assembly of the package.

In addition with the modification of FIG. 21, the blank **170*a* is formed in the outer shell rear wall panel 174*a* with a through opening or hole 208, which may be located medially in spaced relation between the cut end edges 184*a* and 196*a*, and laterally coextensive with and terminating at the longitudinal edges 176*a* and 178*a*. The through opening or hole 208** may be of rectangular, as shown, or of elongate or ovaloid configuration and serves as a finger receiving opening, in a manner which has been described fully in my U.S. Pat. No. 3,749,234.

The outer bottom and top wall panels or flaps 192 and 206 are provided in this case with linear glue strips 210 and 212 for securement to the panels 204 and 194, respectively. Adhesive line **84*a* performs the same function as glue line 84 of FIG. 1 in holding the tab or panel 112*a* in place for providing the necessary pivot point for the inner shell 42*a*. Also, in the modification of FIG. 21, no finger notches or cutouts are necessary, as with the outer blanks of FIGS. 2 and 16**, because of a rear finger access opening.

Figure 20:
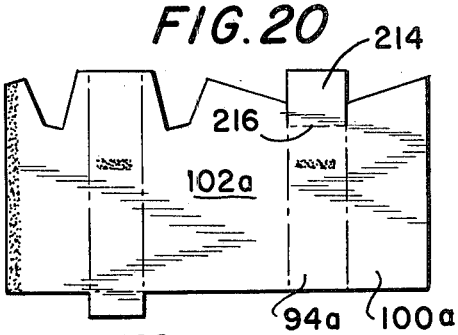
FIG. 20 is a further plan view of another inner shell panel with a full length rear sidewall and extended rear sidewall panel toggle lock tab of the type that fully biases the inner shell to both of its operative open and closed positions.

In FIG. 20, a deeper toggle lock tab or "snap-type" locking tab 214 is provided. Its fold line 216 is located further on down the rear panel **94*a* than the fold line 124 of FIG. 1. Note that this panel 94*a* only differs from that of FIGS. 1 and 15 in that it is a full length type of panel construction which is required in an embodiment where a rear access finger hole 208 is provided. In addition, the panels 100*a* and 102*a* are therefore also of the full length type so that the inner shell is a complete hollow box-like structure rather than a partial shell structure, and thus the cigarette bundle is more securely supported over its entire length. In all other respects, the inner shell of FIG. 20 is identical to that of FIGS. 1 and 15. With the deeper unsecured toggle lock panel 214, the biasing action of the operative open and closed conditions or positions of the shells with respect to each other is more stiff, more positive and stronger due to the fact that the tab 214 is full and longer and may also, if desired, be reinforced by being glued to the inside of the depending top rear dust tab 198*a*, as shown by the dot-dash lines in FIG. 23. However, this is not necessary nor required for successful operation of the invention, and the top rear dust tab 198*a* may simply extend downwardly against the inner side of the rear wall panel 174*a*. With such a full-length locking tab 214, the free end thereof is generally always in contact with the fold line or corner of the dust tab 198*a* and inner top wall panel. Consequently, the tab 214 cannot slide outwardly of the corner and away therefrom along the inside of the top wall panel, as possibly could occur in the embodiments of FIGS. 1–14 and FIGS. 15–19**.

The foil wrapper of FIGS. 3 and 4 with its gripping tab 144 may also be suitably utilized with the embodiments of FIGS. 15–16 and 20–21, as best shown, respectively, in FIGS. 17–19 and FIGS. 22–23.

The assembly of the embodiments of FIGS. 15–19 and 20–23 should be readily observed from the figures and in effect is quite similar to that of FIGS. 1–14. More importantly, the method and/or sequence of assembly is generally governed by the type of machinery or equipment employed in the packaging of cigarettes. The package of the present invention is adapted to existing machinery and thus the steps or modes of operation in putting together and completing an entire cigarette dispensing package as shown "sealed" in FIG. 14, is not the type of subject matter to which the applicant seeks protection.

The construction of the inner and outer shells of the further embodiments of FIGS. 24–26 and 29–30 is somewhat similar to one of my earlier two-piece blank constructions, such as shown in FIGS. 42–54 of my U.S. Pat. No. 3,749,234. In such two-piece blank structures, the locking tab is not located on the inner shell, but forms part of the outer shell. Thus, in the further modification of FIGS. 24–26 and 29–30, the inner shell 220 does not have a locking tab 122 extending from fold line 124 of FIG. 1 or **124*a* of FIG. 15, but is otherwise identical in every other respect to the inner shell blanks of FIGS. 1 and 15**.

Figure 29:
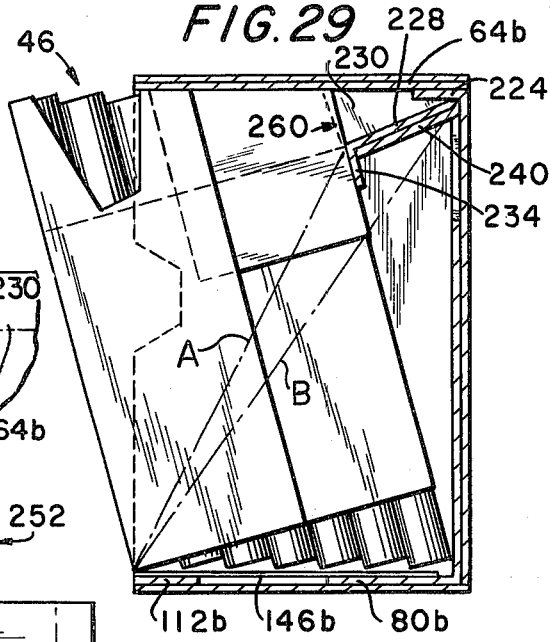
FIG. 29 is a sectional elevational view, like that of FIG. 23, but with the shells of FIGS. 24 and 25 and the foil bundle of FIG. 27.
Figure 28:
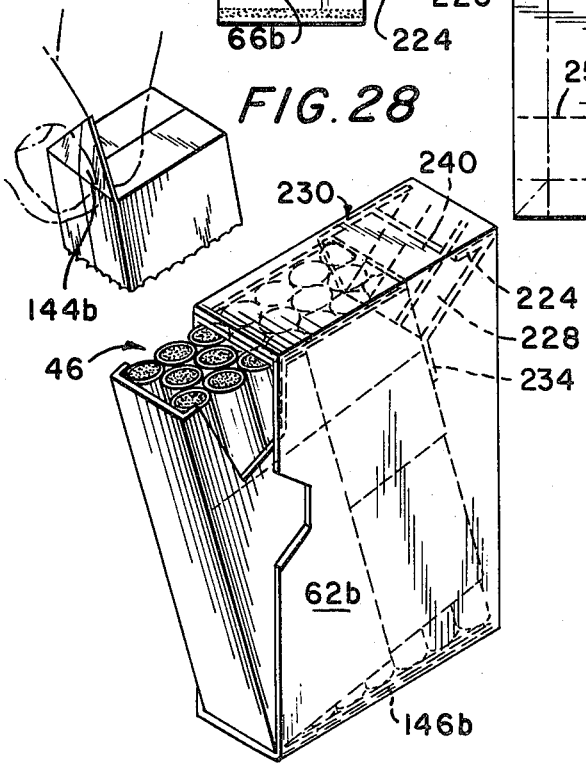
FIG. 28 is a perspective view similar to that of FIG. 5, but showing a fully assembled package employing the shells of FIGS. 24 and 25, and the foil bundle of FIG. 27.
Figure 30:
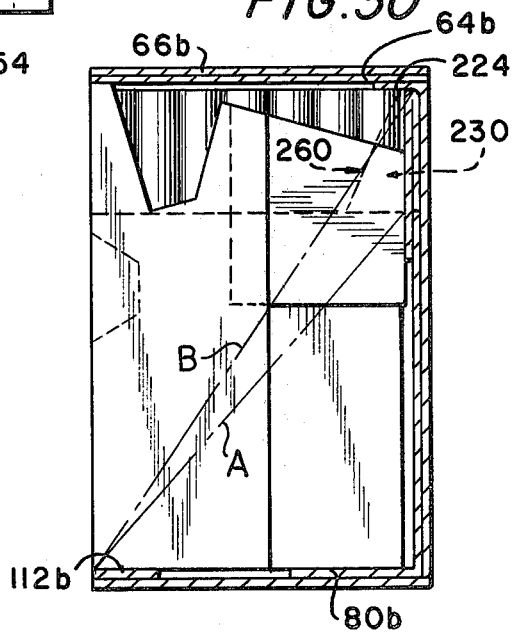
FIG. 30 is a sectional elevational view of the package shown in FIG. 29, but illustrating same in the closed rather than the opened condition.

On the other hand, the outer shell 222 is like that of FIG. 2 with the following exceptions. An optional corner dust tab 224, which precludes cigarette particles, etc. from falling out of the package at said corner, is secured to the inside of the inner top wall panel **64*b*, as best shown in FIGS. 28–30. The dust tab 224 is connected to the outer rear wall panel 78*b* by a fold line 226**.

The inner side wall panel **74*b* has a toggle like lock tab 228 with an additional reinforcement triangular-shaped tab 230 extending from a fold line 232. A further tab 234, extends from fold line 236 at the end of the toggle lock tab 228, and is provided with an adhesive surface on the back side thereof as at 238 (best shown in FIG. 26) for securement to the rear wall panel 94*b* of the inner shell 220**.

Another reinforcement type of tab 240 cut out from the inner rear wall panel **74*b* except for corner "nicks" 242, 244 for initially holding the inner shell 220 in a "sealed" closed condition. As best shown in FIGS. 28–29, the toggle lock tab 228 is adhesively secured to the reinforcement tab 240 by means of the adhesive layer 246 when the lock tab 228 is bent 180° about the fold line 90*b* during assembly of the overall package. Upon the dispensing package being initially opened, the outward pulling of the inner shell 220 into an open condition automatically exerts a force strong enough to break the two corner "nicks" (242, 244) holding the reinforcement tab 240 to the rear panel 74*b*. Thereafter, the reinforcement tab 240 is fixedly secured to the bottom or under side face of the toggle lock tab 228, and the toggle lock tab 228 performs in a function like that of my prior patents for positively and firmly seating the inner shell 220 in either of its two positions, that is, the open or closed conditions, and for precluding the inner shell 220 from being withdrawn completely out of the confines of the outer shell 222. Bear in mind that in the embodiments of FIGS. 1–30, the angled surfaces 130** provide the limit stop feature of preventing the inner shell from being withdrawn completely out of the confines of the outer shell.

Figure 27:
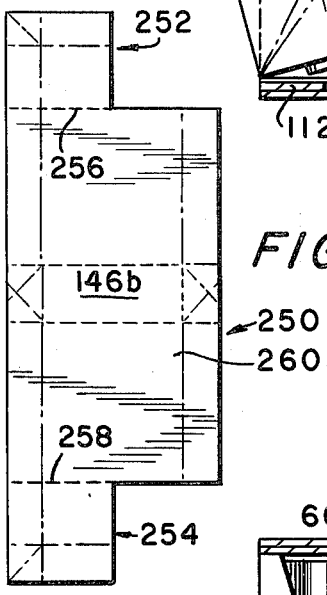
FIG. 27 is a plan view of an alternate foil blank with integral and perforated removable top cover, including perforated (three sides) bottom portion for providing a partial breakaway portion of the cigarette foil bundle upon initial opening of the package.

The foil blank 250 shown in FIG. 27 is of an alternate construction. As seen therein, it comprises an integral and perforated removable top cover portion having a triangular tab portion **144*b*. In this case, however, the top cover portion is formed by two portions 252 and 254 secured by perforated seams 256 and 258, respectively, to the main body portion 260. The main body portion 260 is otherwise identical to that of FIG. 4 and it also has a three-sided perforated bottom portion 146*b***.

The inner shell containing cigarette bundle 46 is formed in a manner similar to that of FIGS. 1–14, except that the tab 234 is secured to the inner shell rear wall **94*b*. The other exception is that the top portion 142 of FIG. 3 is constituted by the top portions 252 and 254 of the foil wrapper 250. The fold actions for the main body portion 250 in wrapping a bundle of cigarettes are the same, but the top cover portions 252,254 fold in the same way together toward each other at the top of the cigarette bundle so as to form the triangular finger gripping tab 144*b*. The operation of the dispensing package of FIGS. 24–30 is thus essentially the same as that of all of the other embodiments described herein. It should be noted, however, that some portion of the side reinforcement panel 230, as best shown at 260 in FIGS. 29 and 30, always remains disposed between the outer shell side wall panel 52*b* and the inner shell side wall panel 102*b*** so as not to interfere with the closing action of the inner shell as it is pushed back into the closed position.

The toggle lock tabs embodied in the various cigarette packages of the present invention operate in a manner basically similar to those employed in my earlier aforementioned patents. Except in the present invention, the toggle lock tab or panel functions only to biasingly maintain a closed package condition wherein the inner shell maintained or held within the confines of the outer shell and cannot be accidentally opened. Thus, in FIGS. 7, 23 and 29, note that the length of the toggle lock tab or panel plus the length of an imaginary diagonal A of the inner shell, is greater than the length of an imaginary diagonal B of the outer shell.

It can be appreciated, therefore, that the imaginary diagonal A (actually the rigid inner shell), and the toggle lock tab or panel define an overcenter toggle mechanism (overcenter with respect to the imaginary diagonal B) which will urge the inner shell either into or out of its fully closed condition or position depending upon which side of the diagonal line B the toggle happens to lie. Thus, if a person should begin to urge the inner shell toward its closed position, once the toggle defined by the toggle lock tab or panel and the imaginary line A passes over the diagonal B or swings across the dead center toggle linkage position, a natural biasing force is inherently developed to snap the inner shell to its fully closed position. The same type of force is generated once the inner shell is pulled out sufficiently from its closed position that the toggle tab or panel and diagonal A passes over the diagonal B.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

What is claimed is:

1. A package for cigarettes and the like, said package comprising: an outer shell having a multiedge bottom surface and a plurality of sidewalls upstanding therefrom, said outer shell including an elongated opening therein; one of said sidewalls constituting a rear wall oppositely disposed with respect to said elongated opening; an inner shell having at least a front and side walls, and said inner shell being pivotally connected to said outer shell and movable between a first position within said outer shell in which the interior of said inner shell is inaccessible and a second position partially out of the confines of said outer shell in which the interior of said inner shell is accessible; a non-connected over-center toggle lock tab extending from a rear wall of said inner shell for firmly seating said inner shell in a closed position within said outer shell by an abutting engagement with the top corner of said outer shell to form a toggle over-center type closure upon closing so as to preclude said inner shell from moving from said first position accidentally; said non-connected over-center toggle lock tab being unsecured to any wall of said outer shell, and stop means for limiting the pivotal travel of said inner shell when said inner shell is in said second position and for precluding said inner shell from being withdrawn completely out of the confines of said outer shell, and said stop means comprising at least one wall surface of said inner shell except for said front wall.

2. The package of claim 1, wherein said inner shell includes a front wall which closes said elongated opening when said inner shell is in its first position, said front wall of said inner shell being hingedly secured to one edge of said bottom surface of said outer shell which is oppositely disposed with respect to the bottom corner of said outer shell.

3. The package of claim 1, wherein said toggle lock tab comprises a member connected to the upper end of said rear wall of said inner shell and when said toggle lock tab member is engaged with said top corner of said outer shell, said member passing overcenter with respect to a first imaginary diagonal joining the upper end of the rear wall of said outer shell with said one edge of said bottom surface whenever said inner shell is moved between its first and second positions.

4. The package of claim 3, wherein the length of said member plus the length of a second imaginary diagonal line joining the upper end of the rear wall of said inner shell with the lower end of the front wall thereof is greater than the length of said first imaginary diagonal, whereby a naturally biased overcenter toggle arrangement is formed which urges said inner shell toward its first or second position when said joining member passes over said first imaginary diagonal.

5. The package of claim 1, including a main body wrapping or foil bundle containing cigarettes or the like, comprising a blank of sheet material having a plurality of fold lines so as to form a bundle having four sides and a bottom when folded, and said bottom portion having perforations along three sides; whereby upon the initial opening of said inner shell, the bottom of said cigarettes exerting pressure, causing said bottom portion of said bundle to simultaneously tear along said perforated sides, thereby automatically breaking away said bottom portion without a direct manual contact, so as to cooperate with the movement and positions of said inner shell in relation to said outer shell without damaging the contents of said foil bundle.

6. The package of claim 5, including a removable top corner portion covering said cigarettes adjacent the corner opening of said inner shell, said corner portion formed of sheet material having a plurality of fold lines which form a four-sided corner portion having an extending finger tab for gripping purposes enabling removal of said top corner portion.

7. The package of claim 6, wherein said top corner portion and said body wrapping are integrally formed from a single blank of sheet material; and said top corner portion is attached to said body wrapping by means of perforations, thereby facilitating the removal of said top corner portion upon the gripping and pulling of said finger tab.

8. The package of claim 1, wherein said one wall is a side panel of said inner shell.

9. The package of claim 1, wherein said stop means is formed by side panel walls of said inner shell.

10. The package of claim 1, wherein said stop means is formed by said rear wall of said inner shell and by side panel walls of said inner shell.

11. The package of claim 9, including finger opening notches in said side panel walls of said outer shell adjacent said elongated opening of said outer shell to facilitate gripping said side panel walls of said inner shell for opening said package to said second position.

12. The package of claim 1, including a finger opening in said rear wall of said outer shell to facilitate pushing said rear wall of said inner shell to force said inner shell to swing open to said second position out of the confines of said outer shell.

13. The package of claim 9, wherein said rear wall and said side panel walls of said inner shell are of full length and extend to a common bottom edge.

14. The package of claim 1, including a bundle for wrapping said cigarettes in a predetermined sized pack; said bundle comprising a main body portion and a partial breakaway bottom portion which is automatically torn when said package is initially opened.

15. The package of claim 14, wherein said breakaway bottom portion is perforated along three bottom side edges of the main body portion; and said cigarettes causing said breakaway portion to tear along the perforated side edges of said bottom portion when said package is opened.

16. The package of claim 15, wherein said bundle includes a removable top corner portion.

17. The package of claim 16, wherein said removable top corner portion includes extending tab means for gripping purposes.

18. The package of claim 16, wherein said top cover portion is integrally formed with said main body portion of said bundle.

19. The package of claim 18, wherein said top cover portion is secured to said main body portion by perforated lines in said bundle.

20. The package of claim 14, wherein said bundle is made from thin foil sheet material.

21. The package of claim 20, wherein said sheet material is provided with a plurality of fold lines which form said bundle, and the bottom corners of said bundle are folded so that corner tabs are externally disposed so as not to interfere with the bottom of said cigarettes in said bundle.

22. The package of claim 9, wherein said side panel walls of said inner shell are provided with oppositely disposed cutout portions which form side wall openings in the inner shell for easy access to the packaged products.

23. A two-piece blank for forming a side-opening package having inner and outer shells for cigarettes or other articles, said blank comprising: an inner shell blank having a front wall panel having a lower end flap hinged thereto, a rear wall panel, at least two side wall panels connectable to said front and rear wall panels by parallel fold lines, and a toggle lock tab extending from the upper portion of said rear panel of said inner shell and being connected thereto by a fold line; and an outer shell blank having a bottom wall panel having an end edge, at least one top wall panel, side wall panels connectable to said top and bottom wall panels by parallel fold lines, at least one rear wall panel having a side panel hinged thereto; and said lower end flap of said inner shell blank adapted to be secured at said end edge of said bottom wall panel of said outer shell blank for pivotally mounting said inner shell blank to said outer shell blank for forming a package, wherein said toggle lock tab firmly seats said inner shell within said outer shell by being unsecured to any wall of said outer shell and being capable of separable abutting engagement with the top corner of said outer shell to form a toggle over-center closure only upon closing so as to preclude said inner shell from accidental movement out of a closed position.

24. The blank of claim 23, wherein one of said side wall panels of said inner shell blank comprising separate first and second portions which when joined together form a complete side panel and form a four side frame of tubular shape for said inner shell.

25. A two-piece blank for forming a side-opening package having inner and outer shells for cigarettes or other articles, said blank comprising: an inner shell blank having a front wall panel having a lower end flap hinged thereto, a rear wall panel, at least two side wall panels connectable to said front and rear wall panels by parallel fold lines, and a toggle lock tab extending from the upper portion of said rear panel of said inner shell and being connected thereto by a fold line; and an outer shell blank having a bottom wall panel having an end edge, at least one top wall panel, at least one rear wall panel, side wall panels connected by fold lines to said rear wall panel and to said top and bottom wall panels; and said lower end flap of said inner shell blank adapted to be secured at said end edge of said bottom wall panel of said outer shell blank for pivotally mounting said inner shell to said outer shell for forming a package, wherein said toggle lock tab firmly seats said inner shell within said outer shell by being unsecured to any wall of said outer shell and being capable of separable abutting engagement with the top corner of said outer shell to form a toggle overcenter closure only upon closing so as to preclude said inner shell from accidental movement out of a closed position.

26. The blank of claim 25, wherein one of said side wall panels of said inner shell comprising separate first and second portions which when joined together form a complete side panel and form a four side frame of tubular shape for said inner shell.

27. A two-piece blank for forming a side-opening package having inner and outer shells for cigarettes or other articles, said blank comprising: an inner shell blank having a front wall panel having a lower end flap hinged thereto, a rear wall panel, at least two side wall panels connected to said front and rear wall panels by parallel fold lines; and an outer shell blank having a bottom wall panel having an end edge, at least one top wall panel, side wall panels connectable to said top and bottom wall panels by parallel fold lines, at least one rear wall panel hinged to a side panel and having an outer fold line, at the fold line connecting said top and side wall panels, a toggle lock tab extending outwardly and beyond said outer fold line of said rear wall panel and being connected thereto by said outer fold line at the upper edge of said rear wall panel; and said lower end of said flap of said inner shell blank adapted to be secured at said end edge of said bottom wall panel of said outer shell blank for pivotally mounting said inner shell to said outer shell for forming a package, wherein said toggle lock tab of said outer shell is secured to said rear wall of said inner shell and said toggle lock tab forming an over-center hinge arrangement in the form of a toggle enabling the seating of said inner shell firmly in an open and closed relation to said outer shell.

28. The blank of claim 27, wherein one of said side wall panels of said inner shell comprising separate first and second portions which when joined together form a complete side panel and form a four side frame of tubular shape for said inner shell.

29. The two-piece blank of claim 28, including a first reinforcement panel being integrally formed with said rear panel of said outer shell blank but extending therefrom for securement to said toggle lock tab for strengthening and reinforcing same.

30. The blank of claim 38, including a triangular-shaped reinforcement panel connected to said toggle lock tab by means of a fold line for providing additional stiffness to said toggle lock tab.

31. A two-piece blank for forming a side-opening package having inner and outer shells for cigarettes or other articles, said blank comprising: an inner shell blank having a front wall panel having a lower end flap hinged thereto, a rear wall panel, at least two side wall panels connectable to said front and rear wall panels by parallel fold lines, and a non-connecting over-center toggle lock tab, extending from a fold line of the upper portion of said rear panel of said inner shell, being unsecured to any wall of said outer shell; and an outer shell blank having a bottom wall panel having an end edge, at least one top wall panel, at least one rear wall panel having an aperture, side wall panels connected by fold lines to said rear wall panel and to said top and bottom wall panels; and said lower end flap of said inner shell blank adapted to be secured at said end edge of said bottom wall panel of said outer shell blank for pivotally mounting said inner shell to said outer shell for forming a package, wherein said non-connecting toggle lock tab seats said inner shell firmly in both an open and closed relation with respect to said outer shell without being connected to said outer shell.

32. The two-piece blank according to claim 31, wherein an end flap hinged to said top wall panel of said outer shell blank is secured to said unconnecting toggle lock tab.

33. The two-piece blank according to claim 27, wherein an end flap hinged to said rear wall of said outer shell blank forms a top corner tab in said outer shell.

* * * * *